US006750854B1

(12) United States Patent
Onishi

(10) Patent No.: US 6,750,854 B1
(45) Date of Patent: Jun. 15, 2004

(54) IMAGE DISPLAYING APPARATUS

(75) Inventor: Tomoya Onishi, Ebina (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/511,691

(22) Filed: Feb. 23, 2000

(30) Foreign Application Priority Data

Feb. 23, 1999 (JP) ..... 11-045509

(51) Int. Cl.[7] ..... G09G 5/00

(52) U.S. Cl. ..... 345/204; 345/67; 345/74; 345/74.1; 345/75; 345/75.1; 345/75.2; 345/76; 345/205

(58) Field of Search ..... 345/204, 205, 345/67, 74, 74.1, 75.1, 75, 76

(56) References Cited

U.S. PATENT DOCUMENTS 6,342,875 B2 * 1/2002 Todokoro ..... 345/74.1

* cited by examiner

*Primary Examiner*—Richard Hjerpe
*Assistant Examiner*—Jean Lesperance
(74) *Attorney, Agent, or Firm*—Fitzpatrick, Cella, Harper & Scinto

(57) ABSTRACT

An image displaying apparatus includes a transparent film adhered to an outer surface of a face plate, and a transparent conductive film formed on an outer surface of the transparent film. When a potential difference is formed between the transparent conductive film and an inner surface of the face plate, a reduction in voltage of the transparent film becomes greater than a reduction in voltage of the face plate.

13 Claims, 9 Drawing Sheets

IMAGE DISPLAYING APPARATUS

BACKGROUND OF THE INVENTION

1. Filed of the Invention

The present invention relates to a construction of a face plate for a flat panel display such as a field emission display (FED), a plasma display panel (PDP), a liquid crystal display (LCD) and the like.

2. Related Background Art

In image displaying apparatus including CRT, larger surface construction has been sought and investigated vigorously. Further, as the large surface construction is achieved, it is important to make the apparatus thinner, lighter and less expensive.

However, in CRT, since electrons accelerated by high voltage are deflected by a deflection electrode to excite phosphor on a face plate, when the large surface is achieved, great depth is naturally required, with the result that is difficult to provide a thinner and lighter weight apparatus. The inventors have investigated a surface conducting type electron emitting element and an image displaying apparatus using such surface conducting type electron emitting elements as an image displaying apparatus capable of solving the above problem.

The Inventors have tried application of a multi electron beam source by using electrical wiring, as shown in FIG. 11, for example. That is to say, there has been provided a multi electron beam source in which a plurality of surface conducting type electron emitting elements are arranged two-dimensionally and these elements are wired in a simple matrix fashion as shown.

In FIG. 11, the reference numeral 4001 denotes the surface conducting type electron emitting elements schematically shown; 4002 indicates row direction wirings; and 4003 indicates column direction wirings.

Incidentally, for clarify's sake, although 6×6 matrix is shown, scale of the matrix is not limited to the illustrated one, but the number of elements sufficient to display a desired image may be wired.

FIG. 12 shows a construction of a cathode-ray tube using this multi electron beam source which includes outer container bottom 4005 and outer container frame 4007 having a multi electron beam source 4004, and a face plate 4006 having a phosphor layer 4008 and a metal back 4009. Further, high voltage is applied to the metal back 4009 of the face plate 4006 from a high voltage power supply 4010 through a high voltage introduction terminal 4011.

In the multi electron beam source in which the surface conducting type electron emitting elements are wired in a simple matrix fashion, in order to output a desired electron beam, an electrical signal is appropriately applied to the row direction wirings 4002 and the column direction wirings 4003.

For example, in order to drive the surface conducting type electron emitting elements in any one row of the matrix, selection voltage Vs is applied to the row direction wiring 4002 in the selected row, and at the same time, non-selection voltage Vns is applied to the row direction wirings 4002 in the non-selected rows. In synchronism with this, drive voltage Ve for outputting an electron beam is applied to the column direction wirings 4003.

According to this method, voltage (Ve−Vs) is applied to the row direction wiring 4002 in the selected row and voltage (Ve−Vns) is applied to the row direction wirings 4002 in the non-selected rows.

By selecting the voltages Ve, Vs, Vns to appropriate values, electron beams having desired intensity are emitted only from the surface conducting type electron emitting elements in the selected row, and, when different drive voltages Ve are applied to the respective column direction wirings, electron beams having different intensity are outputted from the elements in the selected row. Further, since a response speed of the surface conducting type electron emitting element is high, when a time period for applying the drive voltage Ve is changed, a time period for outputting the electron beam can also be changed.

The electron beam outputted from the multi electron beam source 4004 by the above-mentioned voltage application is illuminated onto the metal back 4009 to which high voltage Va is applied, thereby exiting and lighting the phosphor which is a target. Accordingly, for example, by appropriately applying voltage signals in accordance with image information, an image displaying apparatus can be obtained.

In such an image displaying apparatus, the multi electron beam source and the phosphor layer are formed within a glass vacuum container. Further, in many other image displaying apparatuses, a portion by which a picture plane is displayed is formed from a glass member.

If the image displaying portion of the image displaying apparatus is damaged, sharp glass pieces are scattered therearound, with the result that the observer may be in serious danger. Possibility of glass scattering is increased as the image displaying apparatus is made large-sized, and, thus, any means for preventing the glass scattering must be provided.

To this end, a technique in which a glass scattering preventing transparent film is adhered to a front surface of the face plate or a technique in which a transparent front plate made of acryl, polycarbonate or tempered glass is provided outside of the face plate have been proposed.

In the structure in which the glass scattering preventing transparent film is provided, when the voltage Va is applied to the inner surface of the face plate, the outer surface of the face plate and the transparent film are charged, with the result that uncomfortable discharging to the observer will occur or dust will be adhered to the transparent film to make it difficult to observe the picture plane. To avoid this, there has been a technique in which transparent electrodes are provided on the outer surface of the transparent film to form a charge preventing film which is grounded.

In the structure in which the transparent film having the charge preventing film is adhered to the face plate, the following problem occurs. That is to say, when the voltage Va is applied to the inner surface of the face plate and the outer surface of the transparent film is grounded, the face plate is subjected to voltage Vg smaller than Va.

Depending upon the glass used for the face plate, alkali ions (particularly, sodium ions) in the glass are shifted and precipitated and are reacted with moisture and/or carbon dioxide to form hydroxide and/or carbonate which colorize the glass surface to worsen the image quality of the image displaying apparatus.

To avoid this, although glass in which sodium ions are hard to be shifted can be used for the glass member of the face plate, such glass is not preferable since it is generally expensive to increase the entire cost of the apparatus.

SUMMARY OF THE INVENTION

The present invention aims to eliminate the above-mentioned conventional drawbacks, and an object of the present invention is to provide an image displaying apparatus in which shifting of ions in a face plate is suppressed by minimizing voltage to be applied to the face plate, thereby minimizing deterioration of image quality.

To achieve the above object, according to the present invention, there is provided an image displaying apparatus at least comprising a transparent film adhered to an outer surface of a face plate, and a transparent conductive film formed on an outer surface of the transparent film, and wherein, when there is potential difference between the transparent conductive film and an inner surface of the face plate, reduction in voltage of the transparent film becomes greater than reduction in voltage of the face plate.

DETAILED DESCRIPTION OF THE PREFERRED EMBODIMENTS

Figure 1:
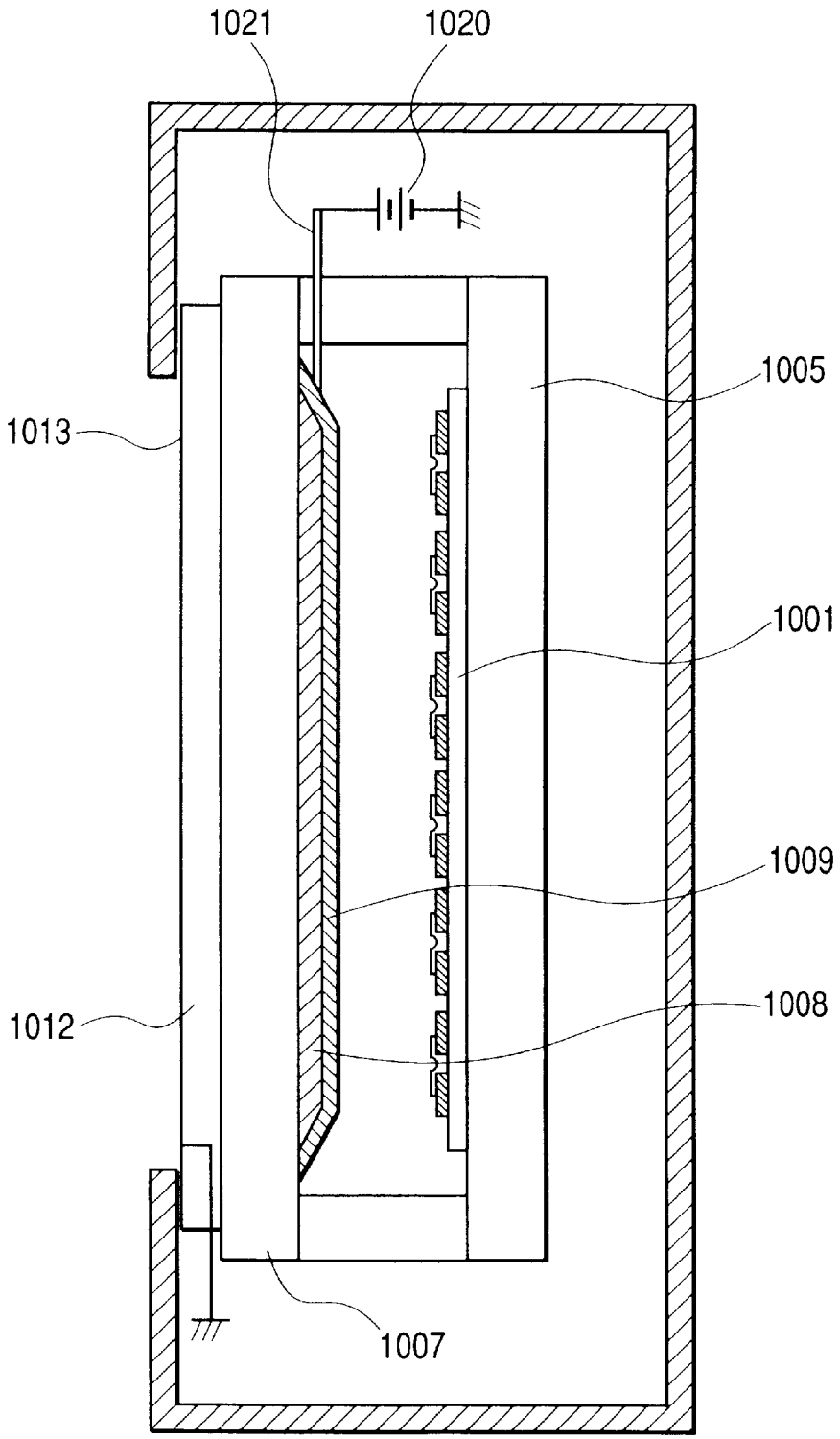
FIG. 1 is a schematic sectional view showing a flat panel display according to a first embodiment of the present invention.

An image displaying apparatus according to the present invention at least comprises a transparent film adhered to an outer surface of a face plate, and a transparent conductive film formed on an outer surface of the transparent film, and, when there is potential difference between the transparent conductive film and an inner surface of the face plate, reduction in voltage of the transparent film becomes greater than reduction in voltage of the face plate.

According to one aspect of the image displaying apparatus of the present invention, when there is potential difference between the transparent conductive film and the inner surface of the face plate, electric resistance of the transparent film becomes greater than electric resistance of the face plate.

The image displaying apparatus according to the present invention at least comprises a transparent film adhered to an outer surface of a face plate, and a transparent conductive film formed on an outer surface of the transparent film, and, as potential Va is applied to an inner surface of the face plate and voltage Vb nearer to grounding potential than the potential Va is applied to the transparent conductive film, when it is assumed that volume resistivity of the face plate is $\sigma g$ ($\Omega\cdot$cm), specific inductive capacity of the face plate is $\epsilon g$, a thickness of the face plate is tg (cm), volume resistivity of the transparent film is $\sigma p$ ($\Omega\cdot$cm), specific inductive capacity of the transparent film is $\epsilon p$, a thickness of the transparent film is tp (cm), inductive capacity in vacuum is $\epsilon O$, an endurance time of image displaying is A, the number for starting application of the potential Va during the endurance time A is B, and when $$Rg=\sigma g\cdot tg$$

$$Rp=\sigma p\cdot tp$$

$$V_{gsat}=\{Rg/(Rg+Rp)\}\cdot(Va-Vb)$$

$$Q=\{(Va-Vb)\cdot\tau/(Rg+Rp)\}\cdot\{5+(0.99\cdot Rp)/Rg\}$$

$$\tau=\{Rg\cdot Rp(Cg+Cp)\}/(Rg+Rp)$$

$$Cg=(\epsilon g\cdot\epsilon O)/10^2\cdot tg$$

$$Cp=(\epsilon g\cdot\epsilon O)/10^2\cdot tp,$$

a relationship of $0.86A\cdot V_{gsat}/Rg+2.38\times10^{-4}\cdot Q\cdot B\leqq10^{-6}$ is satisfied.

In an aspect of the image displaying apparatus according to the present invention, the endurance time A of the image displaying is 30000 hours, and the number for starting the application of voltage Va is 10000.

In an aspect of the image displaying apparatus according to the present invention, the face plate utilizes soda lime glass.

In an aspect of the image displaying apparatus according to the present invention, the transparent film is laminated having two or more layers.

In an aspect of the image displaying apparatus according to the present invention, the transparent film has an external light reflection preventing function.

In an aspect of the image displaying apparatus according to the present invention, the transparent film has a transmittance limiting function.

In an aspect of the image displaying apparatus according to the present invention, an image is displayed by a cathode-ray tube.

In an aspect of the image displaying apparatus according to the present invention, the cathode-ray tube utilizes a surface conducting type electron emitting element.

In the structure in which the voltage Va is applied to the inner surface of the face plate of the flat panel display, when it is assumed that the transparent film having the transparent conductive film to which the voltage Vb nearer to the grounding potential than the potential Va is applied is adhered to the outer surface of the face plate, voltage Vg smaller than Va is applied to the face plate.

When the voltage is applied to the face plate, in dependence upon the kind of glass used in the face plate, sodium ions in the glass are shifted to generate ion current. As a result, the sodium is precipitated to the surface and reacts with moisture and carbondioxide to form hydroxide and/or carbonate which colonize the glass surface to worsen the image quality of the flat panel display.

Figure 2:
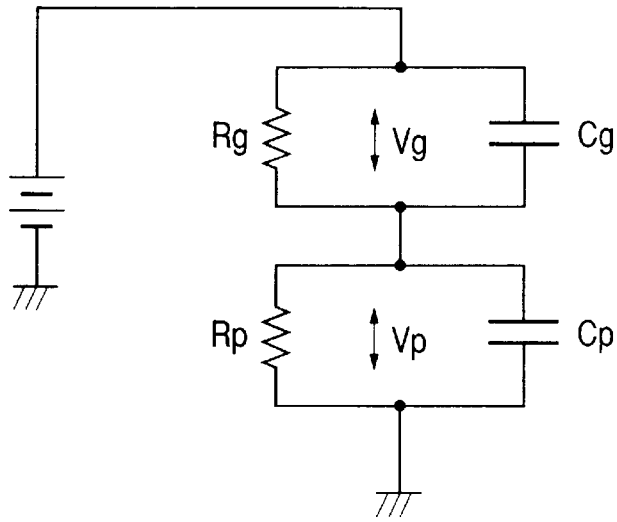
FIG. 2 is a circuit diagram when a face plate and a transparent film are considered as an RC circuit.

In the above-mentioned structure, it is considered that the face plate has resistance component Rg and capacity component Cg, and the transparent film has resistance component Rp and capacity component Cp, and the voltage Vg applied to the face plate can be sought approximately from a circuit shown in FIG. 2. In the circuit shown in FIG. 2, if the voltages Va, Vb are applied instantaneously from a power supply 1020, the voltage Vg applied to the glass is (Vg=) Va−Vb and is gradually approached to saturated voltage $V_{gsat}$ with time constant and can be represented by the following formula:

$$Vg = Vgsat\left(1 + \frac{Rp}{Rg}\exp\left(-\frac{t}{\tau}\right)\right)$$

where, $$Vgsat = \frac{Rg(Va - Vb)}{Rg + Rp}$$

$$\tau = \frac{RgRp(Cg + Cp)}{Rg + Rp}$$

Further Rg, Cf and Rp, Cp are resistance and capacity of the face plate and resistance and capacity of the transparent film per unit area, and, when it is assumed that volume resistivity of the face plate is δg (Ω·cm), specific inductive capacity of the face plate is ϵg, a thickness of the face plate is tg (cm), volume resistivity of the transparent film is δp (Ω·cm), specific inductive capacity of the transparent film is ep, a thickness of the transparent film is tp (cm) and inductive capacity in vacuum is ϵO, the following formula can be obtained:

$$Rg = \sigma_g \cdot t_g$$

$$Rp = \sigma_p \cdot t_p$$

$$Cg = \frac{\varepsilon_g \cdot \varepsilon_0}{10^2 \cdot t_g}$$

$$Cp = \frac{\varepsilon_p \cdot \varepsilon_0}{10^2 \cdot t_p}$$

Figure 3:
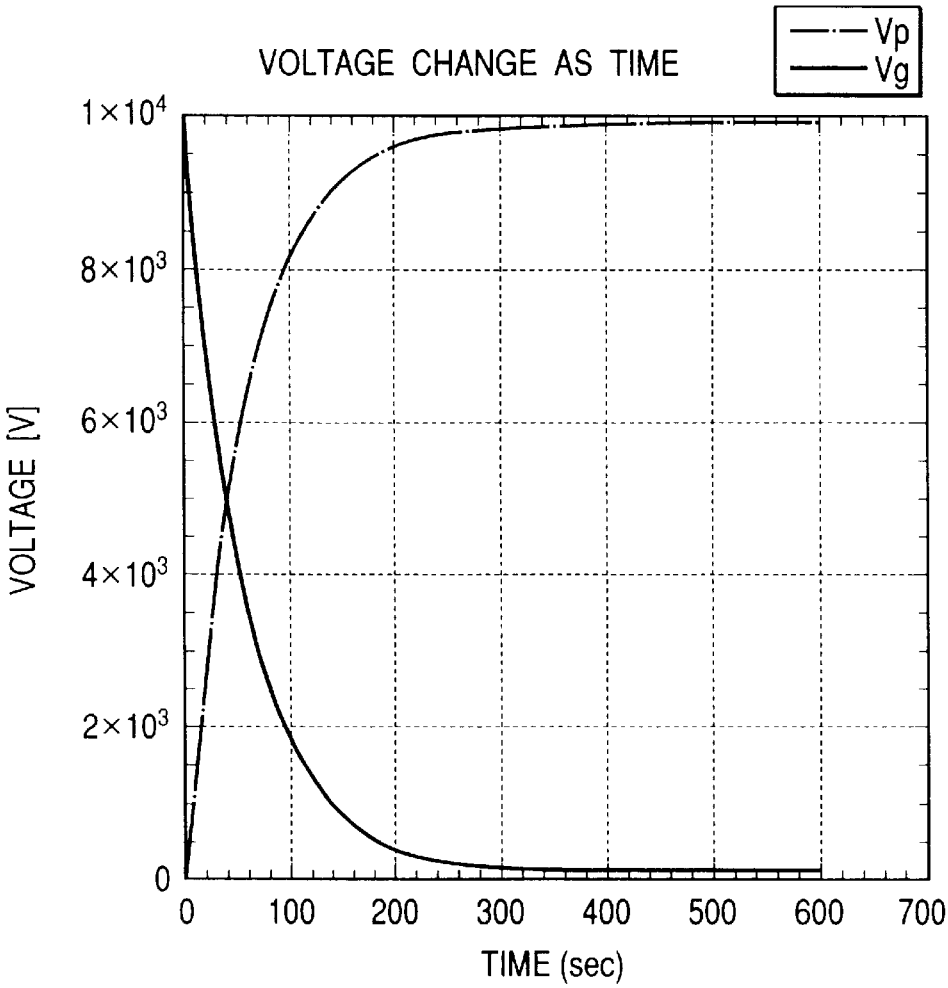
FIG. 3 is a graph showing an example of "voltage change as time" of the face plate and the transparent film according to the present invention.

FIG. 3 shows an example of time-lapse change in the voltage Vg applied to the glass and the voltage Vp applied to the transparent film in this case. Here, Va=10000−Vb (V), and the ordinate is Vg−Vb.

Here, the voltage Vg after the voltage Va was applied can be considered as the following two time zones:

1) time: t≦5τ→ zone until Cg, Cp are charged;
2) time: t≧5τ→ zone where the saturated voltage $V_{gsat}$ continues to be applied to the face plate.

When the voltage is applied to the face plate, quantity of the sodium precipitated to the outer surface of the face plate can be sought from charge quantity of the ion current flown through the glass. The sodium quantity m (g/cm$^2$) precipitated per unit area can be represented by the following formula:

$$m = \frac{Q \cdot Mr}{n \cdot F} = i \cdot t \cdot 3600 \cdot \frac{Mr}{F \cdot n} = i \cdot t \cdot 3600 \times 2.38 \times 10^{-4} = 0.86 \cdot i \cdot t$$

Where, Q (C/cm$^2$) is flown charge quantity, Mr is molecular weight (here, 23 because of Na (sodium)), n is electrochemical equivalent (here, 1), F=9.65×104 (C/mol) is Faraday constant, i (A/cm$^2$) is density of current flowing through the face plate, and t (hour) is time. By using this, the precipitated quantities of sodium per unit area regarding the above 1) and 2) can be represented as follows:

$$① \; m1 = 238 \times 10^{-4} \cdot Q \cdot B$$

wherein, $$Q = \frac{(Va - Vb) \cdot \tau}{Rg + Rp}\left(5 + \frac{0.99 \cdot Rp}{Rg}\right)$$

$$② \; m2 = \frac{0.86 \cdot A}{Rg} Vgsat$$

Where, B (times) is the number for starting application of the voltage Va from the power supply 1020, i.e., the number for turning ON the power supply, and A (hour) is a time duration in which the saturated voltage $V_{gsat}$ is applied in 2).

From the above, when it is assumed that the endurance time of image displaying of the display is A and the number for applying the voltage Va is B (times), the precipitated quantity m (g/cm$^2$) of the sodium per unit area is represented as follows:

$$m = m1 + m2 = 0.86 \cdot \frac{A \cdot Vgsat}{Rg} + 2.38 \times 10^{-4} \cdot Q \cdot B$$

Then, a relationship between the precipitation quantity of sodium and the image quality of the display was sought from tests. A sample was prepared by forming ITO (Indium Tin Oxide) transparent conductive films on both surfaces of a soda glass plate having a thickness of 2.8 mm. And, high voltage was applied to the sample to precipitate sodium, and change in light transmittance of glass and appearance of glass were evaluated.

Figure 4:
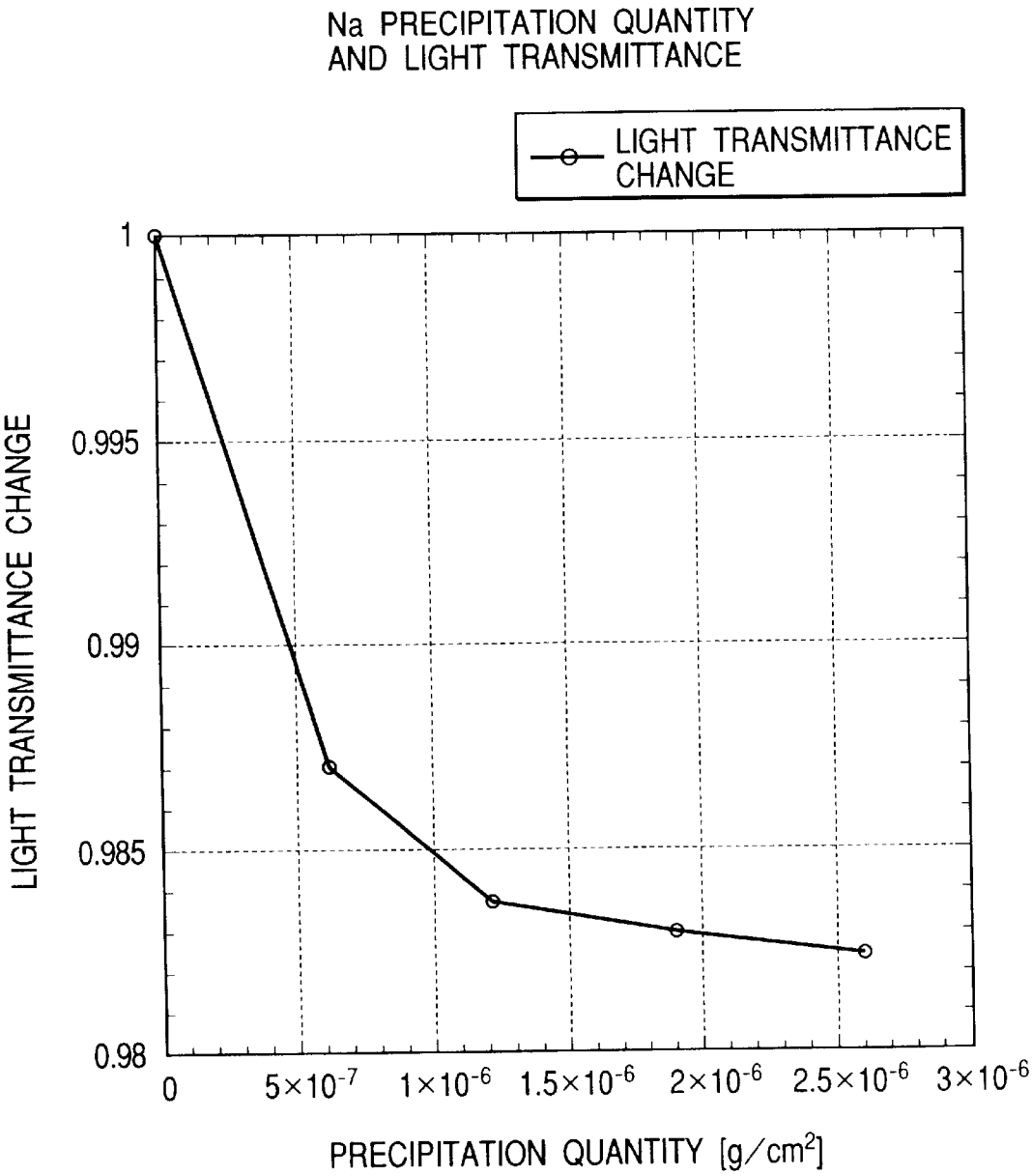
FIG. 4 is a graph showing change in light transmittance when sodium is precipitated from soda lime glass in the face plate according to the present invention.

FIG. 4 shows the change in light transmittance of soda lime glass with respect to precipitation quantity of sodium (Na) per unit area. From FIG. 4, it can be seen that, as the sodium is precipitated, the light transmittance is decreased. Further, by observing the appearance of the glass, it was found that unevenness in the transmittance is gradually generated from Na precipitation quantity of about $1\times10^{-6}$ (g/cm$^2$) and the unevenness in the transmittance can clearly be ascertained visually from Na precipitation quantity of about $2\times10^{-6}$ (g/cm$^2$). Accordingly, it is preferable that the precipitation quantity of sodium is smaller than $1\times10^{-6}$ (g/cm$^2$) in order to avoid deterioration of the image quality of the flat panel display.

From the above, according to the flat panel display of the present invention, in a structure in which the voltage Va is applied to the inner surface of the face plate of the flat panel display, the transparent film having at least the transparent conductive film is adhered to the outer surface of the face plate, and when it is assumed that volume resistivity of the face plate is σg (Ω·cm), specific inductive capacity of the face plate is ϵg, a thickness of the face plate is tg (cm), volume resistivity of the transparent film is σP (Ω·cm), specific inductive capacity of the transparent film is ϵP, a thickness of the transparent film is tp (cm) and inductive capacity in vacuum is ϵo (F/m), the following relationship is satisfied:

$$0.86 \cdot \frac{A \cdot Vgsat}{Rg} + 2.38 \times 10^{-4} \cdot Q \cdot B \leq 10^{-6}$$

In this case, the image quality of the flat panel display can be prevented from being deteriorated by the precipitation of sodium from the face plate.

Further, in general, it is required that the endurance (service life) time A of the display be 30,000 (hours) or more. Further, in consideration of A=30,000, the number B for starting the application of voltage Va was selected to 10,000 (times) (B=10,000). From the above, after the used time of the display reached 30,000 hours and when the number for starting the application of voltage Va reached to about 10,000, the Na precipitation quantity m (g/cm$^2$) per unit area is represented as follows:

$$m = m1 + m2 = 0.86 \cdot \frac{A \cdot Vgsat}{Rg} + 2.38 \times 10^{-4} \cdot Q \cdot B$$

Accordingly, in the flat panel display of the present invention, the endurance time A of the image displaying is 30,000 hours and the number B for starting the application of voltage Va is 10,000 times, and, by satisfying the following relationship, a service life feature which is generally required can be satisfied:

$$0.86 \cdot \frac{30000 \cdot Vgsat}{Rg} + 2.38 \times 10^{-4} \times 10000 \cdot Q \leq 10^{-6}$$

Furthermore, in the flat panel display of the present invention, by using the soda lime glass to form the face plate, cost of the glass material can be reduced, and, thus, the manufacturing cost can be reduced.

Further, in the flat panel display of the present invention, when the materials for the face plate and the transparent film are determined, even if it is difficult and/or expensive to obtain a required thickness of the transparent film to achieve the required resistance Rp, by laminating two or more transparent films, the laminated film having the required resistance Rp can be obtained thereby to reduce precipitation of sodium.

Furthermore, in the flat panel display of the present invention, by providing means for preventing reflection of external light on the transparent film, deterioration of image quality caused by overlapping an image of the external light reflected on the transparent film with the displayed image can be prevented.

Furthermore, in the flat panel display of the present invention, by providing a function for limiting or regulating transmittance on the transparent film, quantity of external light reflected on the phosphor surface can be reduced, thereby enhancing contrast.

Now, several embodiments of the present invention will be described with reference to the accompanying drawings.

First Embodiment

Figure 5:
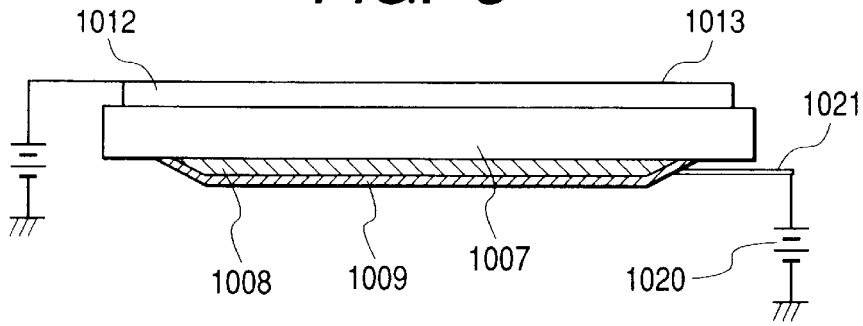
FIG. 5 is a schematic sectional view showing the face plate and the transparent film of the flat panel display according to the first embodiment of the present invention.

First of all, referring to FIGS. 1, 5 and 6, a face plate and a transparent film of a flat panel display according to a first embodiment of the present invention will be explained.

A phosphor layer 1008 having a thickness of about 20 $\mu$m is formed on an inner surface of a face plate 1007 made of soda lime glass and having a thickness of 3 mm, and the phosphor layer is coated by an aluminum metal back layer 1009 having a thickness of about 1000 Å. A high voltage introduction terminal 1021 is connected to the aluminum metal back 1009 and is also connected to a high voltage power supply 1020 so that high voltage Va (Va=10 kV in the illustrated embodiment) is applied to the terminal.

A transparent film 1012 having a glass scattering preventing function and a charging preventing film 1013 is adhered to an outer surface of the face plate 1007. In the illustrated embodiment, although material of the transparent film 1012 is polyethylene terephtalate (PET) and the charging preventing film 1013 is formed from ITO transparent conductive film, of course, the present invention is not limited to this, but, for example, a method for coating conductive high molecular substance may be used, so long as the charging preventing function can be achieved. Further, while an example that the transparent film is adhered to the face plate by using transparent tacky substance is explained, of course, the present invention is not limited to such an example, but, for example, transparent adhesive may be used.

As mentioned above, when the face plate is made of soda lime glass and has the thickness of 3 mm and the transparent film 1012 is made of PET, the following relationship must be satisfied to prevent deterioration of image quality due to precipitation of sodium from the face plate:

$$0.86 \cdot \frac{30000 \cdot Vgsat}{Rg} + 2.38 \times 10^{-4} \times 10000 \cdot Q \leq 10^{-6}$$

However, the endurance time was selected to 30,000 hours and applications of voltage Va (=10 kV) were repeated by 10,000 times. Here, volume resistivity $\sigma g$ of the face plate is $7.0 \times 10^{12}$ ($\Omega$·cm), specific inductive capacity $\epsilon g$ of the face plate is 7.6, a thickness tg of the face plate is 0.3 (cm), volume resistivity $\sigma p$ of the transparent film 1012 is $2.0 \times 10^{16}$ ($\Omega$·cm), and specific inductive capacity $\epsilon p$ of the transparent film is 3.1. Incidentally, these values are in the room temperature.

Figure 6:
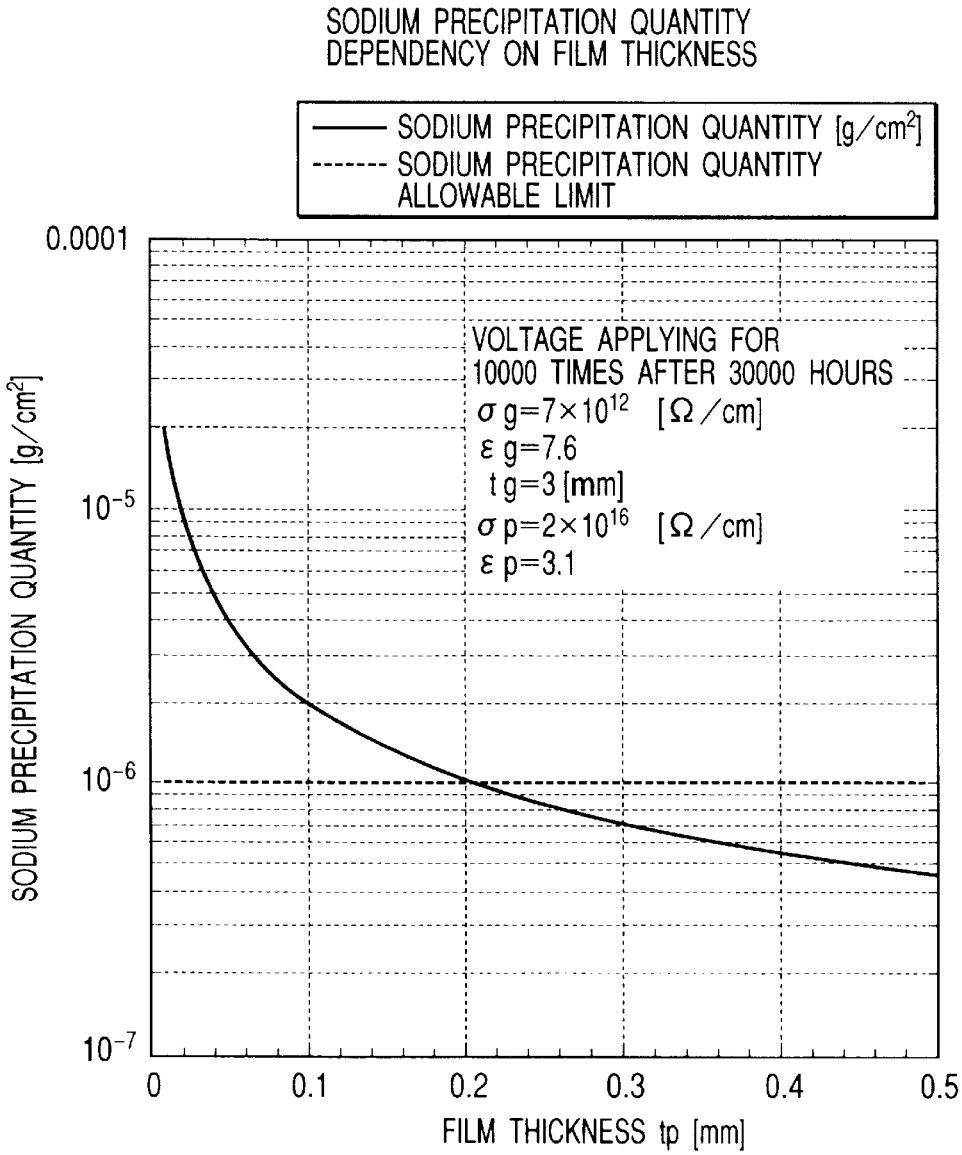
FIG. 6 is a graph showing a relationship between a film thickness and sodium precipitation quality used when a thickness of a PET film is sought, in the first embodiment of the present invention.

In this case, a value of the left terms in the above relationship, i.e., change in sodium precipitation quality per unit area depending upon film thickness, and a value of the right term in the above relationship, i.e., allowable limit value are shown in FIG. 6. As can be seen from FIG. 6, the thickness of the PET film must be 0.2 mm or more in order to prevent the deterioration of the image quality due to sodium precipitation. In the illustrated embodiment, the thickness of the transparent film 1012 was selected to 0.25 mm.

As mentioned above, by adhering the PET film having the thickness of 0.25 mm to the outer surface of the face-plate, if the face plate is damaged, sharp glass pieces can be prevented from being scattered, thereby avoiding serious danger to the observer or operator. Further, by providing the charging preventing film 1013 on the transparent film 1012, the outer surface of the face plate is not charged, with the result that uncomfortable discharging to the observer can be avoided and dust can be prevented from adhering to the transparent film so as not to make it difficult to observe the image. Further, by selecting the thickness of the PET to 0.25 mm, the deterioration of the image quality due to sodium precipitation from the face plate can be prevented.

In this way, when the high voltage is applied to the inner surface (metal back 1009) of the face plate 1007 and the charging preventing film 1013 is grounded (grounding potential), by making reduction in voltage of the transparent film 1012 greater than reduction in voltage of the face plate 1007, ions in the face plate 1007 can be prevented from being shifted.

Next, a construction and a manufacturing method of a display panel of the image displaying apparatus to which the present invention is applied will be described by using a concrete example.

Figure 9:
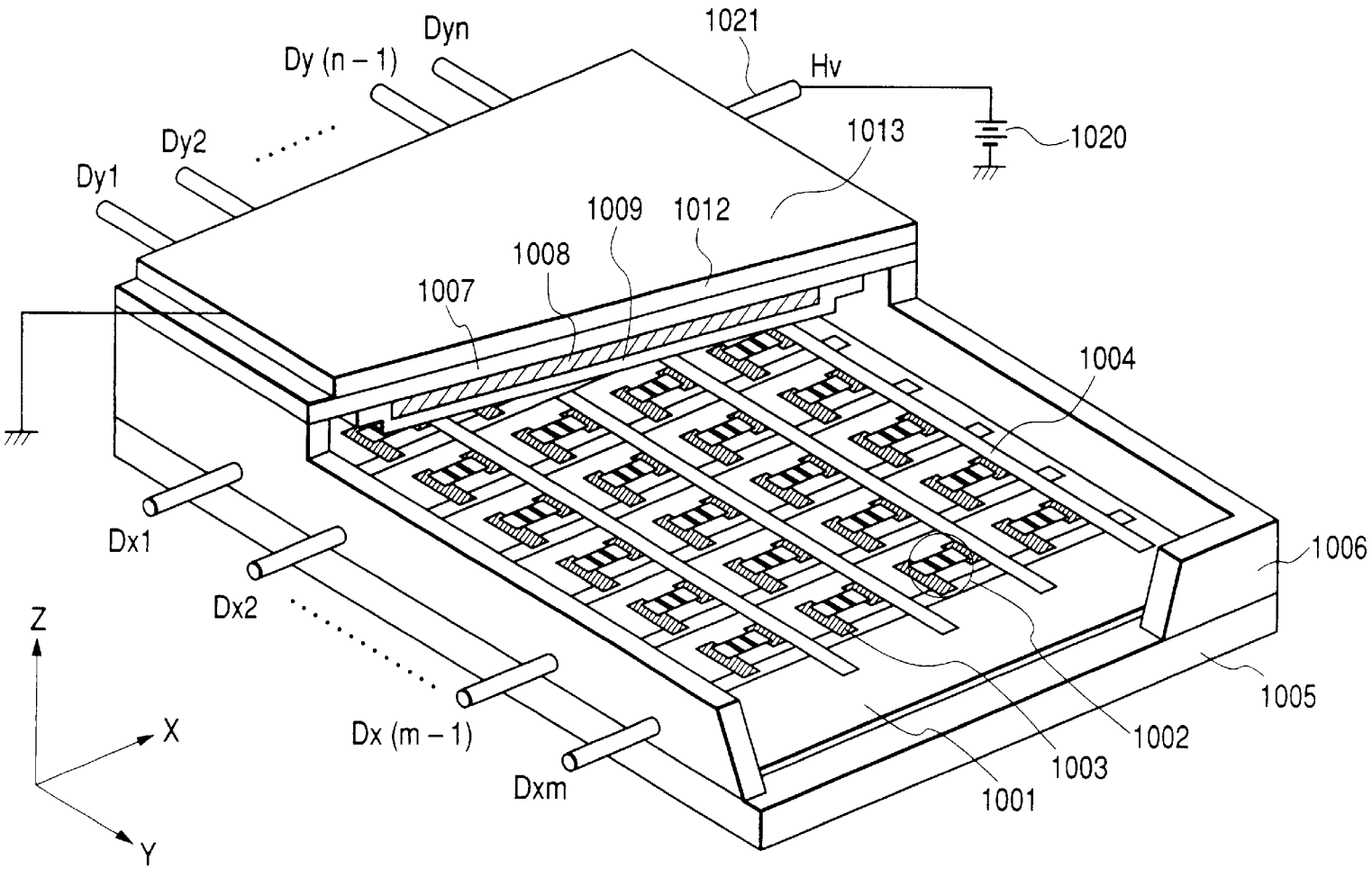
FIG. 9 is a perspective view, partially in section, of a displaying panel of the flat panel display in the embodiment of the present invention.

FIG. 9 is a perspective view of the display panel in the illustrated embodiment, and the panel is partially broken to show an internal construction.

In FIG. 9, an outer container bottom (referred to also as "rear plate" hereinafter) 1005, side walls 1006 and the face plate 1007 define an air-tight container for maintaining vacuum within the display panel.

In the assembling of the air-tight container, seal adhesion is required for maintaining adequate strength and air-tightness at junctions or interfaces between parts or members. To this end, for example, such seal adhesion is achieved by coating frit glass on the interfaces and by effecting firing within air atmosphere or nitrogen atmosphere at 400 to 500° C. for ten minutes or more. A method for making vacuum within the air-tight container will be described later.

A substrate 1001 is secured to the rear plate 1005, and surface conducting type emitting elements 1002 (N×M in number) are formed on the substrate. (N and M are positive integral numbers greater than 2 and are appropriately selected in accordance with desired number of displaying pixels. In the illustrated embodiment, N=3360 and M=630). N×M (in number) surface conducting type emitting elements are wired as a simple matrix by M (in number) row direction wirings 1003 and N (in number) column direction wirings 1004. A portion constituted by parts or elements 1001 to 1004 is referred to as a multi electron beam source.

In the illustrated embodiment, while an example that the substrate 1001 of the multi electron beam source is secured to the rear plate 1005 of the air-tight container is explained, when the substrate 1001 of the multi electron beam source has adequate strength, the substrate 1001 of the multi electron beam source itself may be used as the rear plate of the air-tight container.

Figure 10A:
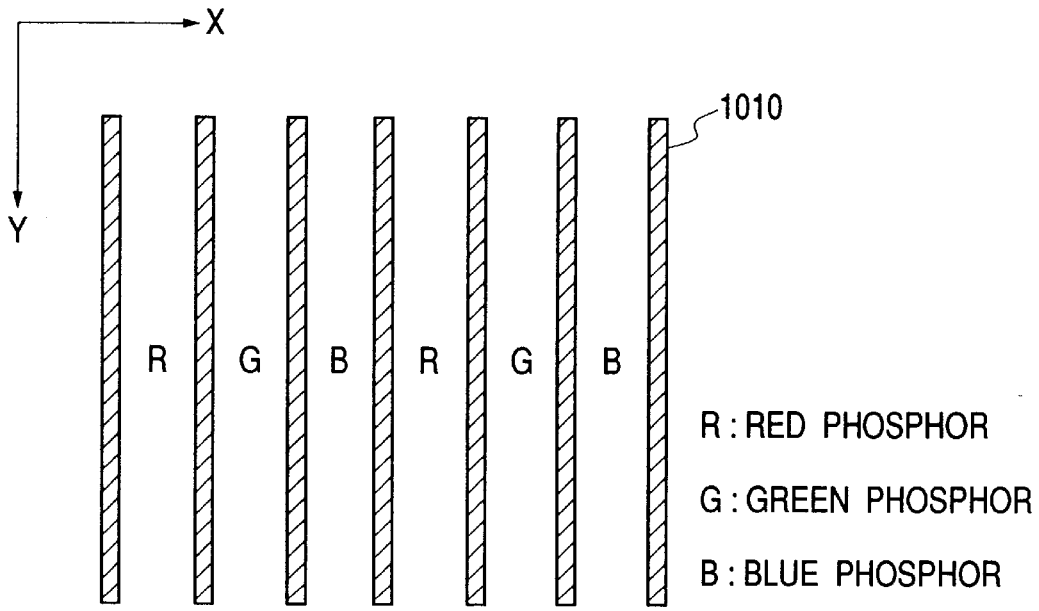
FIGS. 10A and 10B are views showing an arrangement of phosphors of the face plate in the flat panel display according to the present invention.

Further, a phosphor film 1008 is formed on a lower surface of the face plate 1007. Since the displaying apparatus according to the illustrated embodiment is a color displaying apparatus, three original color (red, green, blue) phosphors used in the field of CRT are coated on the phosphor film 1008. As shown in FIG. 10A, the color phosphors are divided as a stripe pattern, and black conductors 1010 are provided between the stripes of phosphors. The purpose for providing the black conductors 1010 is that deviation in color displaying is prevented if the illuminating positions of electron beams are deviated more or less, that reflection of external light is prevented to prevent reduction of displaying contrast, and that charge-up of the phosphor film due to electron beams is prevented. Although the black conductor 1010 is mainly formed from graphite, other material may be used so long as the above purpose can be achieved.

Figure 10B:
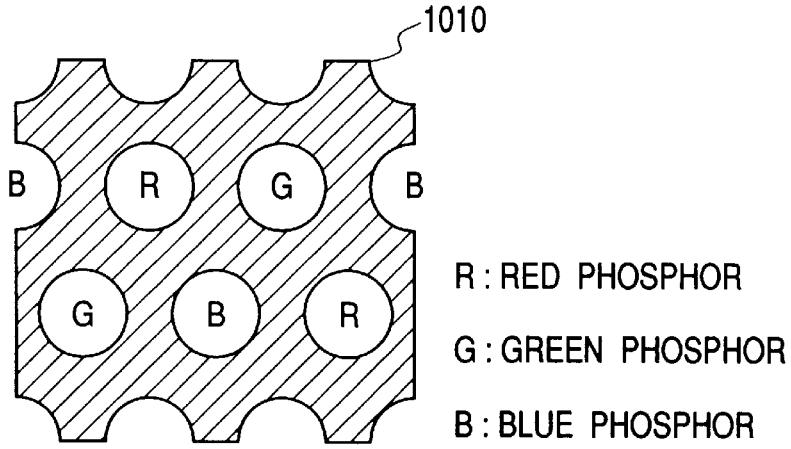
Figure 11:
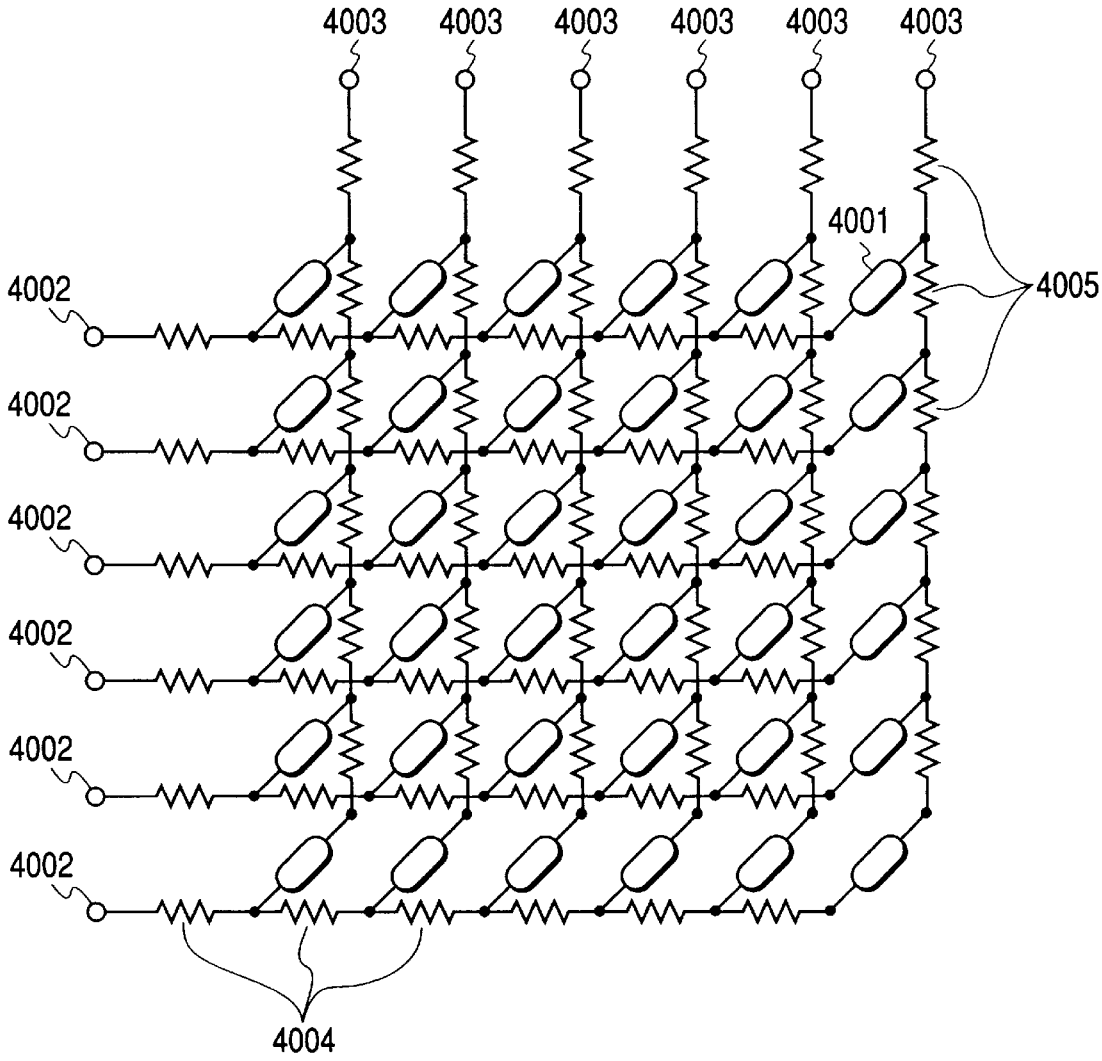
FIG. 11 is a schematic view showing a condition that surface conducting type electron emitting elements are connected and wired in a matrix pattern, in a conventional flat panel display.
Figure 12:
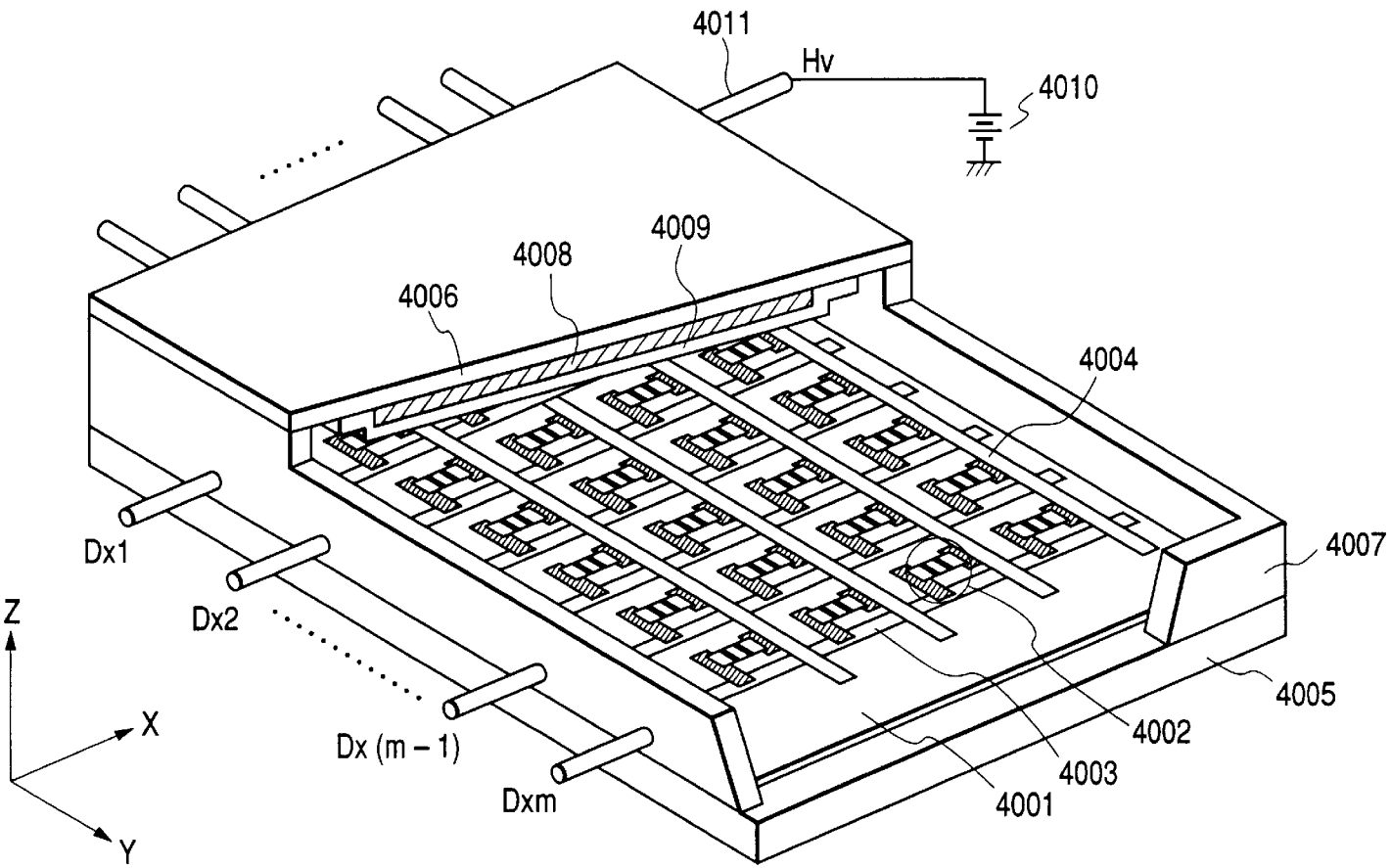
FIG. 12 is a perspective view, partially in section, of a displaying panel of the conventional flat panel display.

Further, a method for dividing the three original color phosphors is not limited to the stripe pattern as shown in FIG. 10A, but, a delta pattern as shown in FIG. 10B or other patterns may be used.

Incidentally, when a monochromatic display panel is formed, uni-color phosphor material may be used in the phosphor film 1008, and the black conductor may not necessarily be used.

Further, the metal back 1009 which is well-known in the field of CRT is provided on a surface of the phosphor film 1008 near (or opposed to) the rear plate. The purpose for providing the metal back 1009 is that part of light emitted from the phosphor film 1008 is mirror-reflected to enhance light utility ratio, that the phosphor film 1008 is protected from collision of negative ions, that the metal back also acts as an electrode for applying electron beam accelerating voltage, and that the metal back also acts as a conductive path for the electrons exciting the phosphor film 1008. After the phosphor film 1008 is formed on the face plate substrate 1007, the surface of the phosphor film is made smooth, and the metal back 1009 is formed on the smooth phosphor film by vacuum deposition. Incidentally, when low voltage phosphor material is used in the phosphor film 1008, the metal back 1009 is not used.

Further, although not used in the illustrated embodiment, in order to be used for application of accelerating voltage and to improve conductivity, for example, transparent electrodes made of ITO material may be provided between the face plate substrate 1007 and the phosphor film 1008.

Further, air-tight electrical connection terminals Dxl-Dxm, Dyl-Dyn and Hv are provided for electrically connecting the display panel to electric circuits (not shown). The terminals Dxl-Dxm are electrically connected to the row direction wirings 1003 of the multi electron beam source, the terminals Dyl-Dyn are electrically connected to the column direction wirings 1004 of the multi electron beam source, and the terminal Hv is electrically connected to the metal back 1009 of the face plate.

Further, in order to make vacuum within the air-tight container, after the air-tight container is assembled, a discharge tube (not shown) and a vacuum pump (not shown) are connected to the air-tight container, so that the air in the air-tight container is discharged to achieve vacuum of about $1\times10^{-7}$ (Torr). Thereafter, the discharge tube is sealed. In order to maintain the vacuum within the air-tight container, immediately before the sealing or after the sealing, a getter film (not shown) is formed at a predetermined position within the air-tight container. The getter film is a film formed by heating and depositing getter material mainly including Ba by a heater or high frequency heating, and, by an absorbing action of the getter film, the interior of the air-tight container is maintained to vaccum of $1\times10^{-5}$ to $1\times10^{-7}$ (Torr). In this way, the fundamental construction and manufacturing method of the display panel according to the illustrated embodiment were explained.

Next, the multi electron beam source used in the display panel according to the illustrated embodiment will be explained. Regarding the multi electron beam source used in the image displaying apparatus of the present invention, so long as the surface conducting type emitting elements are wired in a simple matrix fashion, material, configuration and manufacturing method of the surface conducting type emitting element have no limitation. However, the inventors found that, among the surface conducting type emitting elements, a surface conducting type emitting element in which an electron emitting portion or its peripheral portion is formed from a fine particle film has excellent electron emitting property and can easily be manufactured. Accordingly, it is said that this surface conducting type emitting element is most preferable to be used in the multi electron beam source of the image displaying apparatus having high luminance and a large picture plane. Thus, in the display panel according to the illustrated embodiment, the surface conducting type emitting elements in which an electron emitting portion or its peripheral portion is formed from a fine particle film are used.

As mentioned above, when the high voltage is applied to the inner surface (metal back 1009) of the face plate 1007 and the charging preventing film 1013 is grounded (grounding potential), by making the reduction in voltage of the transparent film 1012 to be greater than the reduction in voltage of the face plate 1007, the ions in the face plate 1007 can be prevented from being shifted.

That is to say, by making the electrical resistance of the transparent film 1012 to be greater than the electrical resistance of the face plate 1007, the ions in the face plate 1007 can be prevented from being shifted, thereby minimizing the deterioration of the image quality.

Second Embodiment

Figure 7:
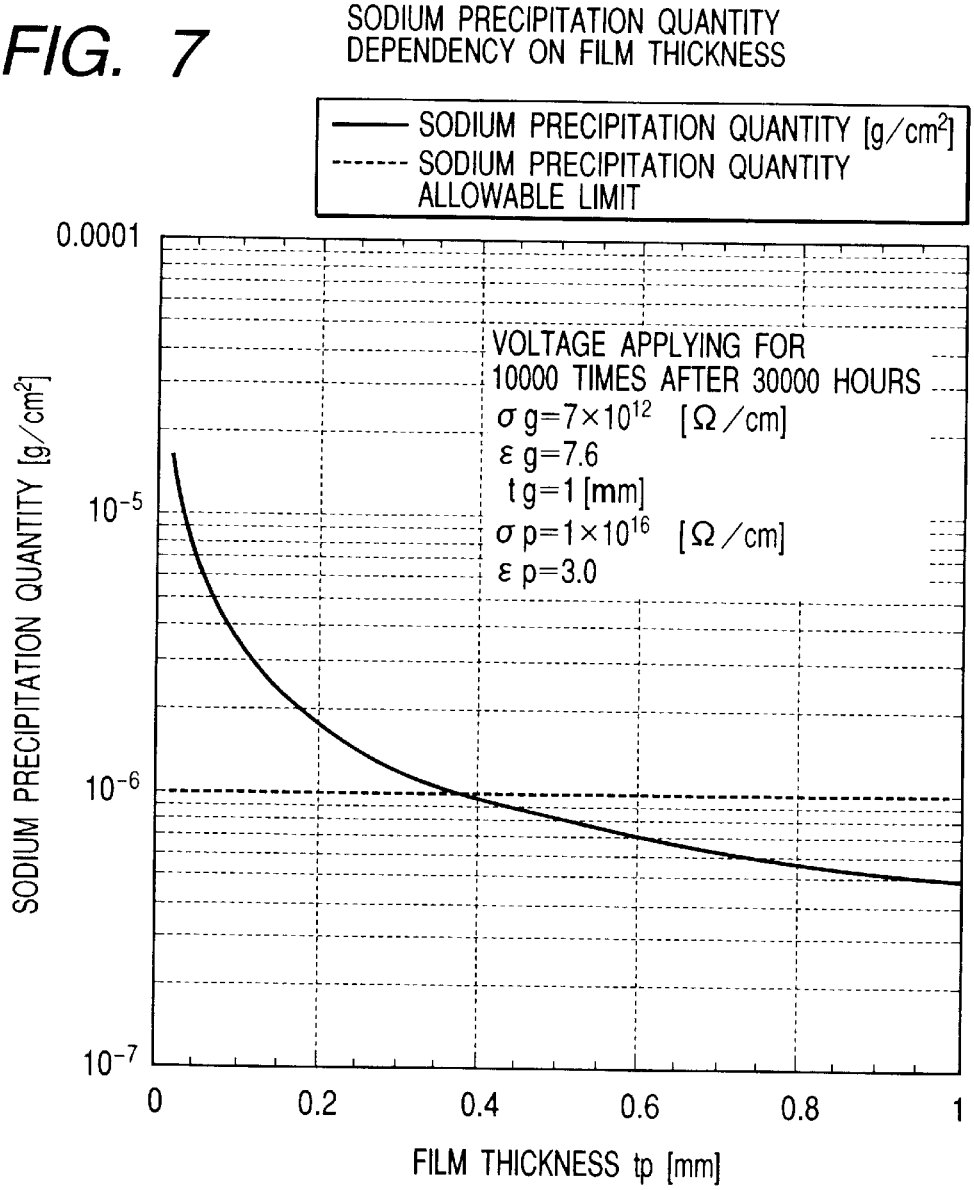
FIG. 7 is a graph showing a relationship between a film thickness and sodium precipitation quality used when a thickness of a polycarbonate film is sought, in a second embodiment of the present invention.
Figure 8:
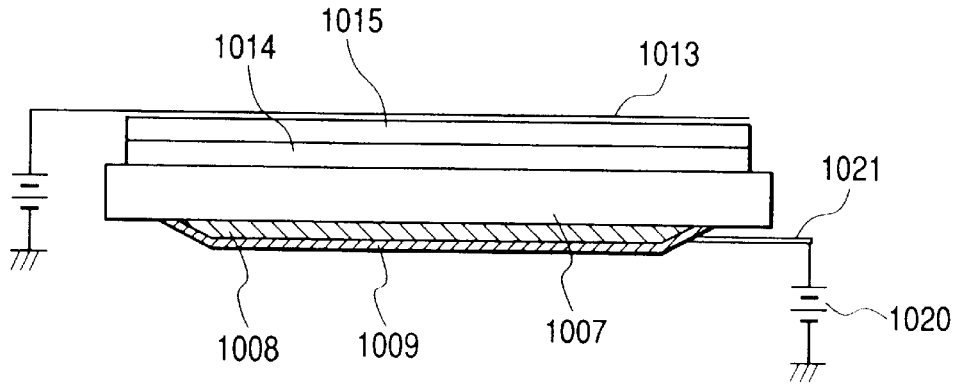
FIG. 8 is a schematic sectional view showing a face plate and a transparent film of a flat panel display according to the second embodiment of the present invention.

Next, a second embodiment of the present invention will be explained with reference to FIGS. 7 and 8. A phosphor layer 1008 having a thickness of about 20 $\mu$m is formed on an inner surface of a face plate 1007 made of soda lime glass and having a thickness of 1 mm, and the phosphor layer is coated by an aluminum metal back layer 1009 having a thickness of about 1000 Å. A high voltage introduction terminal 1021 is connected to the aluminum metal back 1009 and is also connected to a high voltage power supply 1020 so that high voltage Va (Va=10 kV in the illustrated embodiment) is applied to the terminal.

A flat panel display is formed by using the above-mentioned face plate and a multi electron beam source similar to that in the first embodiment, and a transparent film having a glass scattering preventing function and a charging preventing film is adhered to the image display panel. In the illustrated embodiment, as material of the transparent film, polycarbonate is used.

As mentioned above, when the transparent film made of polycarbonate is adhered to the face plate made of soda lime glass, the following relationship must be satisfied to prevent deterioration of image quality due to precipitation of sodium from the face plate:

$$0.86 \cdot \frac{30000 \cdot Vgsat}{Rg} + 2.38 \times 10^{-4} \times 10000 \cdot Q \leq 10^{-6}$$

However the endurance time was selected to 30000 hours and application of voltage Va (=10 kV) were repeated by 10000 times. Here, volume resistivity $\sigma g$ of the face plate is $7.0 \times 10^{12}$ ($\Omega \cdot$cm), specific inductive capacity $\epsilon g$ of the face plate is 7.6, a thickness tg of the face plate is 0.1 (cm), volume resistivity op of the transparent film 1012 is $1.0 \times 10^{16}$ ($\Omega \cdot$cm), and specific inductive capacity $\epsilon p$ of the transparent film is 3.0.

Incidentally, these values are in the room temperature. In this case, a value of the left terms in the above relationship, i.e., change in sodium precipitation quality per unit area depending upon film thickness, and a value of the right term in the above relationship, i.e., allowable limit value for sodium precipitation quantity are shown in FIG. 8. As can be seen from FIG. 8, the thickness of the polycarbonate film must be 0.4 mm or more in order to prevent the deterioration of the image quality due to sodium precipitation.

The polycarbonate film having the thickness of 0.4 mm has rigidity too great to be handled as a roll, and, thus, the film must be worked and transported as the dimension of the panel, thereby increasing the cost. To avoid this, as shown in FIG. 8, two polycarbonate films each having a thickness of 0.2 mm are manufactured, and these two films are laminated to form a single film having a thickness of substantially 0.4 mm, and such a film is adhered to the face plate. In this case, the charging preventing film is provided on an outer film 1015, among the two films 1014, 1015.

Further, as well as the charging preventing film 1013, a multi-layer film capable of reducing reflection of external light due to interference of lights is also provided on the outer surface of the outer film 1015. Further, the film is colorized to regulate or limit light transmittance, thereby improving contrast. While an example that the limitation of transmittance is achieved by colorizing the film was explained, of course, the present invention is not limited to such an example, but, a tacky substance for adhering the films together may be colorized to limit the light transmittance.

As mentioned above, by adhering the polycarbonate film having the thickness of 0.4 mm comprised of two polycarbonate films 1014, 1015 to the outer surface of the face plate, if the face plate is damaged, sharp glass pieces can be prevented from being scattered, thereby avoiding serious danger to the observer or operator.

Further, by providing the charging preventing film 1013 on the transparent film 1015, the outer surface of the face plate is not charged, with the result that uncomfortable discharging to the observer can be avoided and dust can be prevented from adhering to the transparent film so as not to be difficult to observer the image. Further, by making the thickness of the polycarbonate to substantially 0.4 mm, the deterioration of the image quality due to sodium precipitation from the face plate can be prevented.

Further, by providing the function for reducing the reflection of external light on the outer surface of the laminated film, the overlapping between the displayed image and the reflected image of the external light is prevented not to be difficult to observe the image. Further, by regulating the light transmittance by colorizing the film, the quantity of the external light reflected by the phosphor can be reduced to enhance the contrast.

Incidentally, in the above-mentioned embodiments, while examples that the transparent film is made of PET or polycarbonate were explained, of course, the present invention is not limited to such examples, but, for example, acryl or polypropylene (PP) may be used. Further, in the present invention while the transparent film was adhered to the face plate, material having a thickness of 0.5 mm or more and generally referred to as a sheet may be used.

Further, in the above-mentioned embodiments, while an example that the flat panel display using the surface conducting type electron emitting elements and having the face plate 1007 and the transparent film including the charging preventing film was manufactured, of course, the present invention is not limited to such an example, but, a flat panel display can be manufactured by adhering a transparent film to a glass face plate such as a plasma display panel or a liquid crystal display.

In the flat panel display, by providing the transparent film, if the face plate is damaged, sharp glass pieces can be prevented from being scattered, thereby avoiding serious danger to the observer or operator. Further, by providing the charging preventing film on the transparent film, uncomfortable discharging to the observer can be avoided and dust can be prevented from being adhered.

As mentioned above, also in the second embodiment, when the high voltage is applied to the inner surface (metal back 1009) of the face plate 1007 and the charging preventing film 1013 is grounded (grounding potential), by making reduction in voltage of the transparent film 1012 to be greater than reduction in voltage of the face plate 1007, ions in the face plate 1007 can be prevented from being shifted.

That is to say, by making the electrical resistance of the transparent film 1012 to be greater than the electrical resistance of the face plate 1007, the ions in the face plate 1007 can be prevented from being shifted, thereby minimizing the deterioration of the image quality.

According to the present invention, the voltage applied to the face plate can be minimized. Accordingly, an image displaying apparatus in which the ions in the face plate 1007 can be prevented from being shifted, thereby minimizing the deterioration of the image quality can be provided.

What is claimed is:

1. An image displaying apparatus, comprising:

a face plate, a transparent film adhered to an outer surface of said face plate;

a transparent conductive film formed on an outer surface of said transparent film;

an electrode provided at an inner surface of said face plate;

a first voltage power supply supplying voltage to said electrode; and a second voltage power supply supplying voltage to said transparent conductive film, and wherein said transparent film and said face plate are formed from materials generating voltage drops when said first and second voltage power supplies supply different potentials respectively to said electrode and said transparent conductive film, with the voltage drop across said transparent film being larger than the voltage drop across said face plate.

2. An image displaying apparatus according to claim 1, wherein an electrical resistance of said transparent film is greater than an electrical resistance of said face plate.

3. An image displaying apparatus, comprising:

a face plate, a transparent film adhered to an outer surface of said face plate;

a transparent conductive film formed on an outer surface of said transparent film, an electrode provided at an inner surface of said face plate, a first voltage power supply supplying voltage to said electrode; and a second voltage power supply supplying voltage to said transparent conductive film, and meeting a relationship of $0.86A-Vgsat/Rg+2.38X10^{-4}\cdot Q\cdot B\leqq 10^{-6}$, wherein Va is a potential applied by said first voltage power supply to said electrode, Vb is a potential applied by said second voltage power supply to said transparent conductive film and is nearer to ground potential rather than Va, $\sigma g$ is volume resistivity of said face plate, $\epsilon g$ is specific inductive capacity of said face plate, tg is thickness of said face plate, $\sigma p$ is volume resistivity of said transparent film, $\epsilon p$ is specific inductive capacity of said transparent film, tp is a thickness of said transparent film, $\epsilon O$ is inductive capacity in vacuum, A is an endurance time of image displaying, B is number of starting applications of potential Va during the endurance time A, $Rg=\sigma g\cdot tg$ $Rp=\sigma p\cdot tp$, $V_{gsat}=\{Rg/(Rg+Rp)\}\cdot(Va-Vb)$, $Q=\{(Va-Vb)\cdot\tau/(Rg+Rp)\}\cdot\{5+(0.99\cdot Rp)/Rg\}$, $\tau=\{Rg\cdot Rp(Cg+Cp)\}/(Rg+Rp)$, $Cg=(\in g\cdot\in o)/10^2\cdot tg$, and $Cp=(\in g\cdot\in o)/10^2\cdot tp$.

4. An image displaying apparatus according to claim 3, wherein the endurance time A of the image displaying is 30000 hours, and the number for starting the application of the voltage Va is 10000 times.

5. An image displaying apparatus according to any one of claims 1 to 4, wherein said face plate utilizes soda lime glass.

6. An image displaying apparatus according to any one of claims 1 to 4, wherein said transparent film is a laminate having two or more layers.

7. An image displaying apparatus according to any one of claims 1 to 4, wherein said transparent film has an external light reflection preventing function.

8. An image displaying apparatus according to any one of claims 1 to 4, wherein said transparent film has a transmittance limiting function.

9. An image displaying apparatus according to any one of claims 1 to 4, wherein an image is displayed by a cathode-ray tube.

10. An image displaying apparatus according to claim 9, wherein said cathode-ray tube utilizes a surface conducting type electron emitting device.

11. An image displaying apparatus, comprising:

a face plate;

a transparent film adhered to an outer surface of said face plate;

a transparent conductive film formed on an outer surface of said transparent film;

an electrode and a phosphor provided at an inner surface of said face plate;

a first voltage power supply supplying voltage to said electrode; and a second voltage power supply supplying voltage to said transparent conductive film, and wherein said transparent film and said face plate are formed from materials generating voltage drops when said first and second voltage power supplies supply different potentials respectively to said electrode and said transparent conductive film, with the voltage drop across said transparent film being larger than the voltage drop across said face plate.

12. An image displaying apparatus, comprising:

a face plate;

a transparent film adhered to an outer surface of said face plate;

a transparent conductive film formed on an outer surface of said transparent film;

an electrode provided at an inner surface of said face plate; and a first voltage power supply supplying voltage to said electrode, said transparent conductive film being connected to a ground potential, and wherein said transparent film and said face plate are formed from materials generating voltage drops when said first voltage power supply supplies a voltage difference between said electrode and said transparent conductive film, with the voltage drop across said transparent film being larger than the voltage drop across said face plate.

13. An image displaying apparatus, comprising:

a face plate;

a transparent film adhered to an outer surface of said face plate;

a transparent conductive film formed on an outer surface of said transparent film;

an electrode and a phosphor provided at an inner surface of said face plate; and a first voltage power supply supplying voltage to said electrode, said transparent conductive film being connected to a ground potential, and wherein said transparent film and said face plate are formed from materials generating voltage drops when said first voltage power supply supplies a voltage difference between said electrode and said transparent conductive film, with the voltage drop across said transparent film being larger than the voltage drop across said face plate.

* * * * *

UNITED STATES PATENT AND TRADEMARK OFFICE

CERTIFICATE OF CORRECTION

PATENT NO. : 6,750,854 B1
DATED : June 15, 2004
INVENTOR(S) : Tomoya Onishi

It is certified that error appears in the above-identified patent and that said Letters Patent is hereby corrected as shown below:

Column 1,
Line 5, “Filed” should read -- Field --.
Line 19, “is” (second occurrence) should read -- it is --.
Line 37, “clarifys” should read -- clarity’s --.

Column 2,
Line 15, “exiting” should read -- exciting --.

Column 12,
Line 23, “prevented” should read -- prevented so as --.

Signed and Sealed this

Twenty-sixth Day of April, 2005

JON W. DUDAS
*Director of the United States Patent and Trademark Office*